United States Patent [19]

Cubbon et al.

[11] 4,097,536

[45] Jun. 27, 1978

[54] PREPARATION OF A BLEACH

[75] Inventors: Robert Charles Patrick Cubbon, New Castle-U-Lyme; Peter John Russell, Eastham The Wirral; Robert Eric Talbot, Burtonwood; David Thomas Woodbridge, Hitchin, all of England

[73] Assignee: Interox Chemicals Limited, London, England

[21] Appl. No.: 791,003

[22] Filed: Apr. 26, 1977

Related U.S. Application Data

[63] Continuation-in-part of Ser. No. 683,817, May 6, 1976, abandoned.

[30] Foreign Application Priority Data

Nov. 18, 1975 United Kingdom ..... 47388/75
Nov. 1, 1976 Ireland ..... 2426/76

[51] Int. Cl.[2] ..... C11D 7/38; C11D 7/54; C11D 7/18

[52] U.S. Cl. ..... 260/610 R; 8/111; 423/272; 423/273; 252/186

[58] Field of Search ..... 252/186; 260/610 R; 8/111; 423/272, 273

[56] References Cited

U.S. PATENT DOCUMENTS

| | | | |
|---|---|---|---|
| 2,454,254 | 11/1948 | Kuoch | 252/186 |
| 2,927,084 | 3/1960 | Wahl | 252/186 |
| 3,462,370 | 8/1969 | Winter | 252/186 |

*Primary Examiner*—Benjamin R. Padgett
*Assistant Examiner*—Irwin Gluck
*Attorney, Agent, or Firm*—Larson, Taylor and Hinds

[57] ABSTRACT

The present invention provides a process for producing diphthaloyl peroxide comprising the steps of reacting particulate phthalic anhydride with aqueous hydrogen peroxide in a mobile slurry or paste and thereafter separating diphthaloyl peroxide from the aqueous phase. Preferably the minimum volume of hydrogen peroxide solution is employed commensurate with obtaining a mobile slurry or paste in a mole ratio of phthalic anhydride to hydrogen peroxide of 4:3 to 1:3. Preferably the reaction is effected at a temperature of from 25° to 50° C.

Diphthaloyl peroxide is particularly suitable for washing/bleaching fabrics, optionally in conjection with an inorganic persalt e.g. sodium perborate, at a temperature of from 30° to 60° C.

16 Claims, No Drawings

PREPARATION OF A BLEACH

This application is a continuation in part of copending application Ser. No. 683,817 filed May 6, 1976, now abandonded.

The present invention relates to a process for the preparation of diphthaloyl peroxide.

Hitherto, it has been proposed by A Baeyer and V Villiger in 1901 that diphthaloyl peroxide could be produced by reaction between phthalic anhydride and hydrogen peroxide in dilute aqueous alkaline solution. Although Baeyer and Villiger quoted no yields, we obtained yields of only 8% of the theoretical maximum, based on phthalic anhydride present initially, on repetition of their work. Such yields are commercially unacceptable.

According to the present invention, there is provided a process for the production of diphthaloyl peroxide comprising the steps of forming a mobile slurry or paste containing particulate phthalic anhydride and aqeuous hydrogen peroxide, maintaining the slurry or paste mobile until at least some diphthaloyl peroxide has been produced, and thereafter separating the diphthaloyl peroxide from the aqeuous phase.

Herein, the term "mobile," used in relation to the terms "slurry" or "paste," indicates that the slurry or paste is capable of being mixed under the prevailing reaction conditions, and in the chosen apparatus.

In general, we found that by varying the ratio of liquid to solid in the slurry or paste, its mobility is varied, at any given set of reaction conditions in a particular item of mixing apparatus.

It is highly preferable for the reaction mixture to contain only enough, or only slightly more than enough, liquid than the minimum needed to form a mobile slurry or paste during a substantial proportion, e.g. at least half, of the reaction period. Reference hereinafter to the minimum amount of liquid includes a reference to slightly more liquid such as up to 110% of that amount. By selecting appropriate agitators, for example, Z-blade mixers, mixtures containing the minimum volume of liquid will generally be in the form of thick paste. During the course of the reaction, as the hydrogen peroxide is consumed, the mixture becomes less mobile. Mobility can be restored easily by the addition of further amounts of liquid, suitably dilute mineral acid, water or aqueous hydrogen peroxide. Preferably, the amount of liquid added is no more than the minimum amount required to restore mobility to, or retain mobility at its original level. A convenient ratio of liquid to solid, i.e. aqueous hydrogen peroxide to phthalic anhydride, together with any diluent, is the range of 0.5 to 2.0 ml per g, for the initial mixture when a reaction temperature in the range of ambient to 50° C is employed. The amount of liquid to be added, in general, depends not only upon the extent to which the amount of liquid present initially exceeded the minium, but also upon the mixing apparatus. The amount added often falls within the range of 0 to 1 ml of liquid present initially, so that the ratio of solid to total amount of liquid is usually in the range of 4.1 to 0.65:1 ml per g, more often 2:1 to 1:1 ml per g. Alternatively, sufficient liquid may be present initially to obviate the need to add further amounts of liquid. In a further variation, the initial ratio of liquid to solid may be initially greater than the minimum, but as the reaction proceeds the mobility falls to the point at which additional liquid is required thereafter to maintain the mixture mobile.

The reaction to produce diphthaloyl peroxide theoretically requires two moles of phthalic anhydride for each mole of hydrogen peroxide. Use of excess hydrogen peroxide can be advantageous, in that it tends to reduce the amount of phthalic anhydride remaining in the finished product. Consequently, we prefer to use a mole ratio of hydrogen peroxide to phthalic anhydride in the range of 0.5:1 to 10:1 especially in the range of 0.5:1 to 2.5:1, and more particularly in the range of 0.75:1 to 2.5:1. A mole ratio of more than 2 moles phthalic anhydride per mole hydrogen peroxide can be employed, but this results inevitably in the presence of residual phthalic anhydride in the product. It will be recognised that the aforementioned ranges of hydrogen peroxide to phthalic anhydride include not only the amount of hydrogen peroxide present initially, but also any hydrogen peroxide added in the course of maintaining or restoring mobility.

Although we do not wish to be bound by any theory, it is our current belief that a substantial proportion of the phthalic anhydride remains in particulate form, and reacts with the hydrogen peroxide in the solid state. By using particles having an average particle diameter of 10μ to 50μ or lower e.g. obtained by grinding commercially available flake phthalic anhydride, the possibility of residual phthalic anhydride in the product, and thus its appearance during use of the product, can be minimised.

It will be readily apparent that the mole ratio of hydrogen peroxide to phthalic anhydride is related to the concentration of hydrogen peroxide initially present in the aqueous phase and any liquid added to maintain or restore mobility. As described hereinbefore the liquid to solid ratio usually employed is in the range of 4:1 to 0.65:1 ml per g. Now, without straying outside the said range, a mole ratio of hydrogen peroxide to phthalic anhydride of up to 10:1 can be achieved using hydrogen peroxide having the appropriate concentration. There is no need to use a concentration above 50% w/w. We prefer to employ an aqueous solution containing from 10% to 45% w/w hydrogen peroxide when this can be done without straying outside the aforementioned liquid to solid ratio range. Higher concentrations can be employed, such as 60% w/w but in general would be more wasteful of hydrogen peroxide. Lower concentrations especially selected in the range of 7% to 10% w/w hydrogen peroxide can be employed up to a mole ratio of 1.8:1 provided that a liquid to solid ratio of up to 4:1 is employed, or up to 0.9:1 if the maximum liquid to solid ratio is 2:1. It will be recognised that the concentration of hydrogen peroxide is inversely related to the liquid to solid ratio and related to the hydrogen peroxide to phthalic anhydride mole ratio. The prefered ranges of the liquid to solid ratio and mole ratio are respectively 0.75:1 to 2.5:1 and 2:1 to 1:1. Their relationship with concentration of peroxide solution, assuming that any peroxide added has the same concentration as that present initially, can be seen from Table 1 below.

Table 1

| Liquid to solid Ratio (ml:g) | Concentration of hydrogen peroxide solution (% w/w) at hydrogen peroxide to phthalic anhydride mole ratios of respectively | | |
|---|---|---|---|
| | 0.75:1 | 1.5:1 | 2.5:1 |
| 2:1 | 8.5 | 16 | 26 |
| 1.5:1 | 11 | 21.5 | 34 |

Table 1-continued

| Liquid to solid Ratio (ml:g) | Concentration of hydrogen peroxide solution (% w/w) at hydrogen peroxide to phthalic anhydride mole ratios of respectively | | |
|---|---|---|---|
| | 0.75:1 | 1.5:1 | 2.5:1 |
| 1:1 | 16 | 31 | 49 |

In general, we have found that the mixture becomes more mobile as the temperature is raised. Consequently, we prefer to employ a temperature of above ambient, more preferably in the range of from 25° to 50° C, thereby avoiding the increased decomposition of the product which can occur at temperatures above 50° C. In highly desirable embodiments the temperature is selected within the range of 35° to 50° C. In one convenient method of carrying out the process, particulate phthalic anhydride and aqueous hydrogen peroxide are mixed at a pre-selected temperature in the range 25° to 50° C, preferably 35° to 50° C, the temperature is maintained for a short period, such as from 10 to 50 minutes e.g. 15 minutes, whilst any liquid required is added to maintain the reaction mixture mobile, and the mixture is thereafter permitted to cool during the remainder of the reaction period, possibly reaching ambient.

The reactants are normally separated after not more than 20 hours and not less than half an hour. More often, especially if the reaction has proceeded at a temperature of 25° to 50° C for the major proportion of the time, the reaction period is at least 1 hour and frequently not more than 5 hours. Although not unacceptable, a reaction period in excess of 5 hours is less desirable commercially since no significant increase, or even a decrease, in yield of diphthaloyl peroxide generally occurs, and there is a tendency for undesirable by-products to be formed. A reaction period of from 1 to 4 hours is preferable, especially when a temperature of 35° to 50° C is maintained during a substantial part of the period, e.g. at least half.

The reaction between phthalic anhydride and hydrogen peroxide can take place without adjustment of the pH of the system i.e. at the pH obtained when commercially available aqueous hydrogen peroxide solution is contacted with the solid phthalic anhydride. The initial acidity of the aqueous phase can be varied to some extent, however, if desired. The addition of a small amount of acid, e.g. a mineral acid such as sulphuric or phosphoric acid, can lead to a small increase in the reaction yield, and the addition of a small amount of alkali, e.g. an alkali metal hydroxide, such as sodium hydroxide, can tend to make the mixture more mobile. Desirably the mixture initially has a pH as measured of from 0.5 to 3, and preferably from 0.5 to 2.5. The reaction mixture can contain, if desired, a small amount of a non-ionic surfactant, such as an alkylphenol ethoxylate e.g. trimethylnonylphenol ethoxylate, suitably in an amount of from 0.05% by weight, based on the weight of the mixture. The pH adjustment and surfactant addition can each be made separately or together in respect of any combination of the reaction parameters described herein.

Suitably, the diphthaloyl peroxide can be separated from the aqueous phase by conventional techniques, such as by filtering or centrifuging, particularly when the volume of liquid used in the reaction is significantly greater than the minimum amount required to produce a mobile slurry or paste, producing as a result a damp mass. Further separation can then be effected by drying the product in conventional apparatus, such as spray driers or fluid bed driers. However, especially when substantially the minimum amount of liquid has been used in the reaction stage, and the mixing apparatus was sufficiently powerful to allow the mixture to be present as a paste, it can be convenient to omit a filtration or centrifuge stage, and pass directly to a spray drier or fluid bed drier. However, diphthaloyl peroxide in the pure dry state is potentially hazardous, e.g. impact sensitive, so that in practice it is highly desirable to contact the damp diphthaloyl peroxide intimately with a diluent, as described in copending patent application Ser. No. 683,653 filed May 6, 1976. Suitable diluents include aliphatic fatty acids e.g. lauric, myristic, palmitic or stearic acid; solid hydrocarbons melting at almost 40° or higher up to 60° C, optionally containing up to 10% w/w of a sulphurated surfactant; solid aromatic acids, e.g. phthalic acid; short chain aliphatic esters of aromatic acids, e.g. butyl phthalate; carboxymethylcellulose, optionally methylated or hydroxylated; dextrin, gelatin, or starch; boric acid; zeolites; clays and alkali or alkaline earth metal salts of halogen-free acids having a first dissociation constant of at least $1 \times 10^{-3}$, especially sodium sulphate, pyro or polyphosphate, or magnesium sulphate.

All the diluents can be mixed in after the reaction is completed, e.g. magnesium sulphate. However certain of the diluents are substantially water insoluble and can be present during the reaction itself. Such other diluents include fatty acids, e.g. lauric acid, zeolites or bentonite. Preferably, the amount of diluent or diluents used is sufficient to fully desensitise the product. When the diluent is present during the reaction, it must be taken into account in determining the liquid to solid ratio. Since it increases the ratio of hydrogen peroxide solution to solid phthalic anhydride the general effect is that more dilute solutions are used. When the diluent is added afterwards to the reaction mixture or to damp product, sufficient water is added also to enable the resultant mixture to be stirred thus distributing the diluent reasonably evenly throughout the mixture.

One of the by-products in the reaction between phthalic anhydride and hydrogen peroxide is monoperoxyphthalic acid which decomposes "in situ" more rapidly than diphthaloyl peroxide. Consequently, it is preferable to remove monoperoxyphthalic acid. One way of effecting this, is to wash the diphthaloyl peroxide with a small amount of water and/or a non-acidic organic solvent. The organic solvent can be hydrophilic, e.g. acetone or a low molecular weight aliphatic alcohol, e.g. isopropanol, or it can be hydrophobic, e.g. a chlorinated hydrocarbon such as chloroform, or a liquid hydrocarbon. Washing with organic solvents, preferably low molecular weight alcohols, can also remove phthalic anhydride. Conveniently, the washing can be effected either prior to or after separation of the product from the reaction liquor, if such separation stage is employed. One other particularly convenient way of removing monoperoxyphthalic acid is to employ a reducing agent, e.g. sodium sulphite, which can also remove excess hydrogen peroxide, and advantageously forms, "in situ," sodium sulphate, a highly satisfactory diluent. Suprisingly, sodium sulphite appears not to react markedly with diphthaloyl peroxide, and thus the yield of the reaction remains substantially unaltered. Preferably the sodium sulphite is introduced into the reaction mixture as a particulate solid in a small amount of water. The temperature of the mix is preferably cooled below ambient, particularly in the range of 0° to 10° C. Preferably, diphthaloyl peroxide is treated with sufficient sodium sulphite to remove residual monoperoxyphthalic acid and hydrogen peroxide, and also is washed with an organic solvent as described above, in order to remove residual phthalic anhydride. Sodium sulphite or an equivalent reducing agent can be employed following reaction between phthalic anhydride and hydrogen peroxide under any combination of reaction parameters. However such a technique is particularly applicable where the total volume of liquid is or approaches the minimum, thus enabling a filtration or centrifuging stage to be omitted. Consequently in highly desirable embodiments the process comprises the steps of:

(i) reacting hydrogen peroxide with phthalic anhydride employing a minimum liquid to solid ratio; thereby producing diphthaloyl peroxide and possibly monoperoxyphthalic acid;

(ii) introducing sodium sulphite or equivalent reducing agent to substantially remove hydrogen peroxide and monoperoxyphthalic acid;

(iii) drying the product in a fluid bed or spray drier.

Certain embodiments according to the present invention will now be described by way of Example only.

In each Example, phthalic anhydride was added to aqueous hydrogen peroxide containing, where indicated, additives A1 to A5, in a beaker held in a water bath maintained at the temperature shown, and a stirrable slurry resulted. The slurry was stirred continuously with a paddle stirrer, power to the stirrer being increased after about 15 minutes when the slurry began to thicken rapidly. Additional amounts of aqueous hydrogen peroxide (same concentration) and/or water were then slowly added to the slurry, over a period of about 30 minutes, restoring the slurry to approximately its original mobility. The slurry was then allowed to cool to ambient for the remainder of the reaction period. In Example 10, a diluent, lauric acid, together with demineralised water was added after 1 hour of the reaction period. In Examples 11 to 16, the lauric acid together with an additional amount of water was stirred in at the end of the reaction period and mixed for 10 minutes to give a homogeneous mixture.

Diphthaloyl peroxide (DPP) was thereafter recovered by one of techniques A to E, together with an impurity, monoperoxyphthalic acid (MPPA). In technique A, the slurry was filtered and water washed, both under suction, and then dried. In technique B, the slurry was stirred with water for a minute, centrifuged and then dried. In technique C, technique A was followed, with the addition of washing with isopropanol under suction the water washed filter cake. In technique D, technique C was followed, substituting a 20% methylated spirit in water solution for the isopropanol. In technique E, finely ground sodium sulphite heptahydrate (90 g) together with water (40 ml) were stirred into the slurry, with cooling using an ice bath and the white cream dried under vacuum.

In Examples 2 to 4 and 6 to 10, the phthalic anhydride was a commercially available flake material, and in the remaining Examples, the flake material had been ground to an average particle size of 50μ. Additive A1 is sufficient aqueous sodium hydroxide to raise the pH to approximately pH 3, A2 is 0.5 ml of 2N sulphuric acid, A3 is 3.0 ml of 1N sodium hydroxide. A4 is 0.1 ml of a non-ionic surfactant, trimethylnonylphenol ethoxylate available commercially under the name TERGITOL TMN, and A5 was a combination of the non-ionic surfactant and 0.5 ml of 2N sulphuric acid.

The reaction conditions and amounts of reagents and water employed are summarised in the Table, in which the mole ratio shown is that of the total amount of hydrogen peroxide to phthalic anhydride (PAn) the yield is molar, based on the amount of phthalic anhydride added, and the content by weight based on the resultant dried product.

It is to be understood that the invention is not limited to the specific examples which have been offered merely as illustrations and that modifications can be made without departing from the spirit thereof.

THE TABLE

| Ex. No. | Initial Amounts PAn (g) | Initial Amounts $H_2O_2$ (ml) | Amounts Added (mls) $H_2O_2$ (ml) | Amounts Added (mls) $H_2O$ (ml) | Concn. of $H_2O_2$ w/w | Additives | Diluent Addition Diluent (g) | Diluent Addition $H_2O$ (ml) |
|---|---|---|---|---|---|---|---|---|
| 1 | 30 | 30 | 0 | 30 | 35 | | | |
| 2 | 30 | 30 | 0 | 30 | 35 | | | |
| 3 | 30 | 30 | 0 | 12 | 35 | | | |
| 4 | 30 | 17 | 0 | 14 | 35 | | | |
| 5 | 32 | 30 | 10 | 30 | 35 | | | |
| 6 | 32 | 30 | 10 | 30 | 35 | | | |
| 7 | 32 | 30 | 10 | 17 | 35 | | | |
| 8 | 32 | 30 | 10 | 0 | 35 | | | |
| 9 | 32 | 30 | 10 | 2 | 35 | A1 | | |
| 10 | 1280 | 1300 | 400 | 0 | 35 | | 1000 | 1000 |
| 11 | 32 | 30 | 10 | 5 | 35 | | 10 | 20 |
| 12 | 32 | 30 | 10 | 5 | 35 | A2 | 10 | 20 |
| 13 | 32 | 30 | 10 | 5 | 35 | A3 | 10 | 20 |
| 14 | 32 | 30 | 10 | 5 | 35 | A4 | 10 | 20 |
| 15 | 32 | 30 | 10 | 5 | 35 | A5 | 10 | 20 |
| 16 | 32 | 30 | 10 | 5 | 35 | | | |
| 17 | 32 | 30 | 10 | 5 | 18 | | 10 | 20 |
| 18 | 20 | 15 | 7 | 12 | 12.5 | | 6 | 12 |
| 19 | 32 | 30 | 10 | 5 | 35 | | 10 | 20 |

| Ex. No. | Mole Ratio | Redction temp. (° C) | Reaction Time (hours) | Recovery Technique | Yield % DPP | Yield % MPPA | Content % DPP | Content % MPPA |
|---|---|---|---|---|---|---|---|---|
| 1 | 1.8 | 25 | 20 | B | 50 | 10 | 78 | 14 |
| 2 | 1.8 | 25 | 5 | B | 57 | 11 | 72 | 16 |
| 3 | 1.8 | 35–40 | 4 | A | 59 | 7 | 70 | 10 |
| 4 | 1.15 | 35–40 | 4 | A | — | — | 66 | 17 |
| 5 | 2.25 | 25–30 | 4 | C | 32 | 3 | 83 | 7 |
| 6 | 2.25 | 25–30 | 4.5 | B | 54 | 12 | 68 | 19 |
| 7 | 2.25 | 35 | 4 | B | 58 | 20 | 68 | 26 |
| 8 | 2.25 | 40 | 4 | A | 75 | 7 | 93 | 8 |
| 9 | 2.25 | 25–30 | 4 | B | 44 | 13 | 65 | 21 |
| 10 | 2.25 | 35–40 | 1.67 | C | — | — | 42 | 1 |
| 11 | 2.25 | 35–40 | 4 | D | 65 | 4 | 69 | 4 |
| 12 | 2.25 | 35–40 | 4 | D | 67 | 3 | 67 | 3 |
| 13 | 2.25 | 35–40 | 4 | D | 30 | 2 | 51 | 3 |
| 14 | 2.25 | 35–40 | 4 | D | 74 | 3 | 74 | 3 |
| 15 | 2.25 | 35–40 | 4 | D | 71 | 2 | 70 | 2 |
| 16 | 2.25 | 35–40 | 4 | E | 74 | 2 | 32 | 1 |
| 17 | 1.2 | 35–40 | 4 | D | 78 | | | |
| 18 | 0.6 | 35–40 | 4 | D | 53 | 4 | 37 | 3 |
| 19 | 2.25 | 35–40 | 2 | D | 71 | 6 | 62 | 5 |

We claim:

1. A process for the production of diphthaloyl peroxide comprising the steps of:

(i) forming a mobile slurry or paste containing aqueous hydrogen peroxide and particulate phthalic anhydride in a mole ratio of from 2:1 to 1:10;

(ii) maintaining the slurry or paste mobile and mixing the slurry or paste for a period of at least half an hour at a temperature of from ambient to 50° C, thereby forming particulate diphthaloyl peroxide and;

(iii) thereafter separating the diphthaloyl peroxide from the aqueous phase.

2. A process according to claim 1 wherein the initial ratio of liquid to solid in step i) is selected within the range of 2:1 to 0.5:1 ml per g.

3. A process according to claim 1 wherein the volume of liquid employed initially in step i) is substantially the minimum volume commensurate with obtaining a mobile slurry or paste and the mobility of the slurry or paste in step ii) is maintained or restored to at least its original level by addition of additional amounts of an aqueous solution selected from the group consisting of aqueous hydrogen peroxide, dilute aqueous mineral acid and water.

4. A process according to claim 1 wherein the initial ratio of liquid to solid in step i) is sufficient by itself to allow the slurry or paste to remain mobile during the course of step ii).

5. A process according to claim 1 wherein the concentration of hydrogen peroxide is from 10 to 45% by weight.

6. A process according to claim 1 wherein the total ratio of hydrogen peroxide to phthalic anhydride is within the range of 0.5:1 to 2.5:1.

7. A process according to claim 6 wherein the ratio of hydrogen peroxide to phthalic anhydride is within the range of 0.75:1 to 2.5:1.

8. A process according to claim 1 wherein the temperature in step ii) is maintained in the range of 35° to 50° C for at least 10 minutes and optionally is thereafter permitted to fall.

9. A process according to claim 1 wherein step ii) lasts from 1 to 4 hours.

10. A process according to claim 1 wherein the pH of the aqueous phase in step i) as adjusted within the range of pH 0.5 to 3.

11. A process according to claim 1 wherein the slurry or paste formed in step i), contains up to 0.5% by weight of a nonionic surfactant.

12. A process according to claim 1 wherein the diphthaloyl peroxide is intimately contacted with a desensitising amount of a solid desensitising diluent and is thereafter dried.

13. A process according to claim 1 wherein the slurry or paste formed in step i) contains a solid water soluble desensitising diluent in an amount sufficient to desensitise the diphthaloyl peroxide formed in step ii).

14. A process according to claim 1 wherein the diphthaloyl peroxide produced in step ii) is contacted prior to step iii) with a reducing amount of sodium sulphite.

15. A process according to claim 14 wherein step iii) is effected by spray drying or in a fluid bed drier.

16. A process according to claim 1 wherein a) the slurry or paste formed in step i) has a liquid to solid ratio of 0.5:1 to 2:1; b) the concentration of hydrogen peroxide is from 10 to 45% by weight; c) in step ii) mobility is maintained by addition of up to 1 ml of liquid per ml present initially and the ratio of total hydrogen peroxide added and present initially to phthalic anhydride is from 0.75:1 to 2.5:1, and the temperature maintained for a period of 10 to 50 minutes at 35° to 50° C and thereafter no further heat is supplied during the remainder of the reaction period of up to 4 hours;

d) the diacyl peroxide produced in step ii) is contacted with a reducing amount of sodium sulphite and thereafter spray dried.

* * * * *